US005570952A

United States Patent [19]

Protz, Jr.

[11] Patent Number: 5,570,952

[45] Date of Patent: Nov. 5, 1996

[54] LIGHT STAKE

[75] Inventor: William F. Protz, Jr., Lake Forest, Ill.

[73] Assignee: Santa's Best, Northfield, Ill.

[21] Appl. No.: 387,134

[22] Filed: Feb. 9, 1995

[51] Int. Cl.[6] ..... F21S 1/00

[52] U.S. Cl. ..... 362/431; 248/71; 248/741; 248/156

[58] Field of Search ..... 362/153.1, 249, 362/391, 431; 248/156, 71, 74.1, 530

[56] References Cited

U.S. PATENT DOCUMENTS

| | | | |
|---|---|---|---|
| 4,774,648 | 9/1988 | Kakuk et al. | 362/431 |
| 4,996,636 | 2/1991 | Lovett | 362/431 |
| 5,398,180 | 3/1995 | Lee | 362/391 |

*Primary Examiner*—Stephen F. Husar
*Assistant Examiner*—Sara Sachie Raab
*Attorney, Agent, or Firm*—Emrich & Dithmar

[57] ABSTRACT

A light stake for positioning a series of decorative bulbs in sockets along a wire connecting the sockets at predetermined positions above the ground. The light stake has a base having an elongated post extending perpendicularly therefrom and a locking mechanism on the base movable between an open position and a locked position. The locking mechanism or mechanisms cooperate with the base fixedly to position the wire connecting a series of decorative bulb sockets with respect to the base when the locking mechanism is in the locked position thereof and the wire is trapped against the base by the locking mechanism. The invention does not rely on a friction fit between the light socket and the base to keep the sockets properly oriented.

24 Claims, 2 Drawing Sheets

LIGHT STAKE

BACKGROUND OF THE INVENTION

This invention relates to light stake useful for positioning a series of decorative bulbs in sockets along a wire connecting the sockets at predetermined positions above the ground. The invention is particularly useful at Christmas time for positioning light bulbs sets or strings around a house or shrubbery or the like. The light stake of the present invention is adapted to be driven into the ground and to fix the sockets at a predetermined distance above the ground.

Various light stakes have been used to accomplish the purpose of the present invention, but all of the light stakes have a variety of shortcomings. Some light stakes can accommodate only one size bulb or socket whereas the present invention is directed to a light stake which can accommodate sockets for the C-7 and C-9 size bulb as well as sockets for mini bulbs. Other light stakes have problems in maintaining the wire sets in place because of a failure to provide mechanism for locking the wires with respect to the light stake. Still other mechanisms rely on a friction fit between the light socket and the light stake to maintain the light socket in place which results in the light sockets frequently falling out or working loose and disengaging from the associated stake.

SUMMARY OF THE INVENTION

Accordingly, an object of the invention is to provide a light stake which cures the various defects of prior art light stakes set forth above.

Another object of the invention is to provide a light stake with a locking mechanism for connecting a series of sockets such that the associated bulb socket cannot disengage accidentally from the associated light stake.

Another object of the invention is to provide a one piece light stake having two locking mechanisms thereon to securely connect the associated socket and wire to the light stake.

Yet another object of the invention is to provide a light stake which may be mounted at various distances above the ground in either a ¾" pipe or a ¼" pipe.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 2:
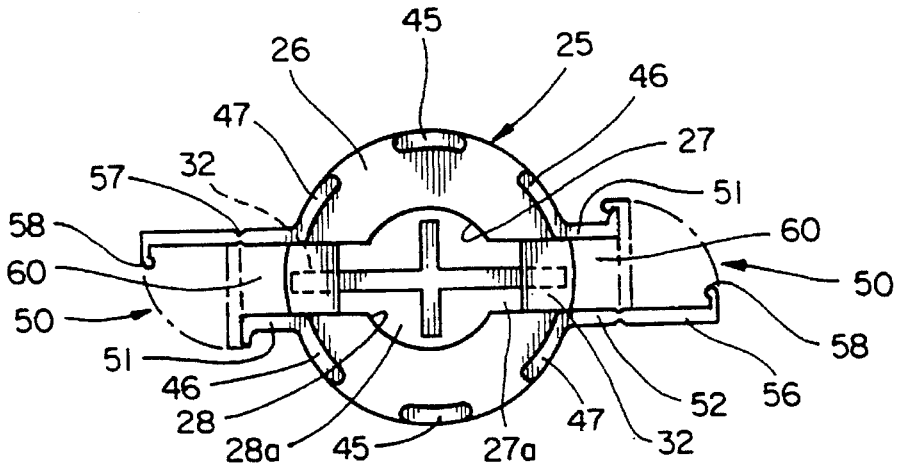
FIG. 2 is plan view of the light stake illustrated in FIG. 1.

Referring now to the drawings, there is disclosed a ground stake 20 including a base 25 comprised of a flat circular portion 26 with slot forming sides 27 which cooperate to form and open slot 27*a* (See FIG. 2) and a circular portion forming sides 28 to cooperate to form a part circular opening 28*a*, also as best seen in FIG. 2.

Figure 1:
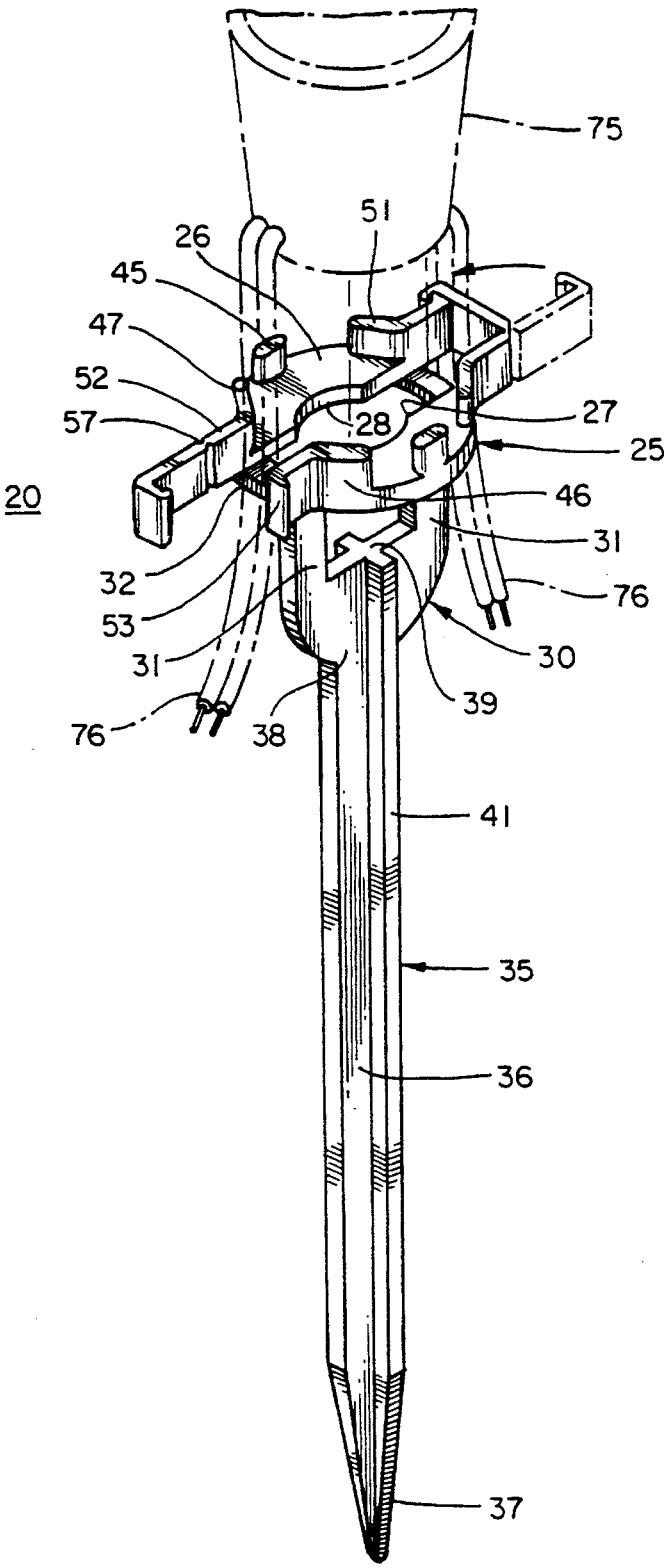
FIG. 1 is a perspective view of the light stake of the present invention illustrating a socket and wire assembly in phantom.

Below the base 25 is a bail 30 having spaced straps 31 connected to mounting segments 32 which interconnect the base 26 on opposite sides of the slot 27*a* and form ends for the slot 27*a* at each end of the base 25. The bail portion 30 has a part arcuate portion 33 which forms the top of a post 35 having an elongated tapered member 36 extending downwardly from the bail 30 and generally perpendicular to the base 25. The elongated tapered member 36 of the post 35 has a pointed end 37 which is adapted to be driven into the ground. The top portion 38 of the post 35 merges with the portion 33 of the bail 30. It should be noted that the post 35 is cruciform in cross section as best seen in FIGS. 1 and 2 in order to provide additional strength to the post 35 which assists when the post 35 is driven into the ground particularly if the ground is semi-frozen. The cruciform shape of the post 35 is provided by a rib 41 which is perpendicular to and extends outwardly from the elongated member 36.

Extending upwardly from the base 25 and in particularly from the flat circular portion 26 thereof, are part circular segments forming ledges 45 which are opposite to each other that is approximately 180° apart and on opposite sides of the part circular opening 28*a* in the base 25. Additional arcuate ledge portions 46 and 47 are positioned opposite each other along the periphery of the circular base 26.

Two locking mechanisms 50 are positioned 180° apart and each includes two tabs 51 and 52 extending outwardly away from the base 26 respectively with part segments 46 and 47. Each of the two tab portions 51 has an outwardly extending end portion 53 which is approximately 90° rotated with respect to the tab portion 51, for purposes hereinafter explained. A movable portion 56 is hingedly mounted as at 57 to the tab portion 52 and is provided with a locking end 58 for cooperation with the end portion 53 of the tab 51, as seen in FIG. 2.

The locking mechanisms 50 each are movable between an open position illustrated in full line in FIGS. 1 and 2 and a closed positioned which is illustrated in dotted line in FIG. 2. When the locking mechanism 50 is in the locked position thereof as illustrated in FIG. 2 there is defined between the tabs 51 and 52 and the movable tab 56 a trapping space 60.

Figure 3:
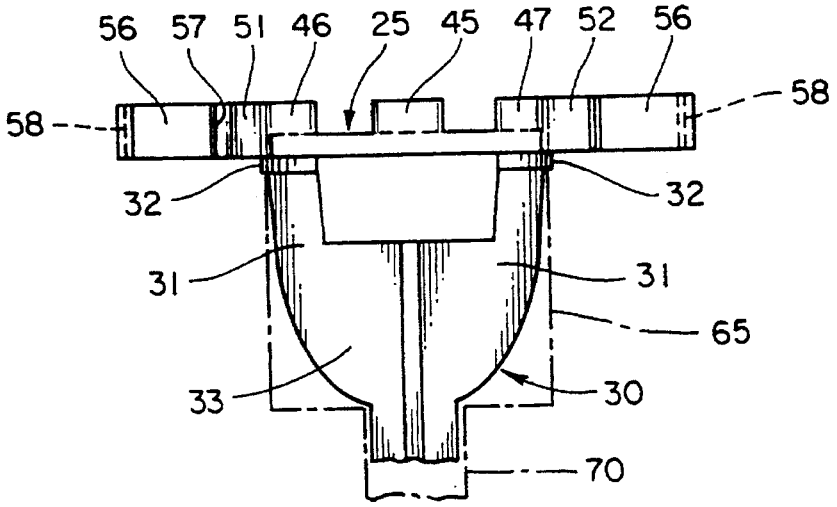
FIG. 3 is a side elevational view of a portion of the light stake illustrated in FIG. 1.
Figure 4:
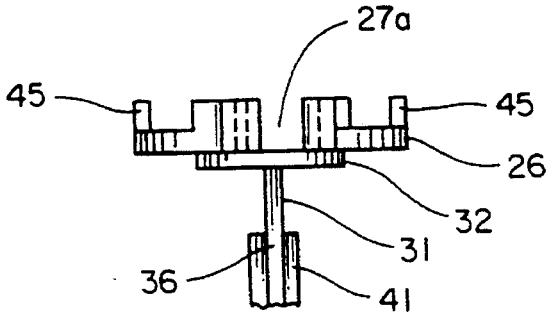
FIG. 4 is an end elevational view of a portion of a light stake illustrated in FIG. 1.

The light stake 50 maybe inserted into the ground or inserted into a pipe segment extending above the ground and there is illustrated in FIG. 3 two such pipe segments, a ¾" pipe segment 65 which generally has an internal diameter of 0.875 inches and a ¼" pipe segment 70 which has a internal diameter of 0.364 inches. The outer diameter of the two straps 31 is 0.875 inches so as illustrated in FIG. 3 the light stake 20 may be driven into a ¾" pipe 65 frictionally be wedged into the pipe 65 if the light stake is driven such that the top of the pipe contacts the mounting segments 32 at the top of the bail strap portion 31. Alternatively, because the post 35 is tapered from a dimension of 0.384 inches at the juncture between the arcuate portion 33 of the bail 30 and the top portion 38 of the post 35 to a diameter 0.275 inches at a point just above the tapered end 37, the post can be wedged into a ¼" pipe 70 which has an internal diameter of 0.364 inches. A schedule 40 pipe will suffice. These dimensions provide added flexibility in the arrangement of strings of lights so that they may be positioned well above the ground by using pipe segments not only of different diameters but different lengths.

In use, a socket 75 having wires 76 extending therefrom, as best seen in FIG. 1, maybe positioned on the base 25 and maintained in place by moving the locking members 50 from their unlocked position to their locked position thereby trapping the wires 76 in the trapping spaces 60 between the tabs 51, 52 and 58. The locking mechanisms 50 are maintained in place by the cooperation between the locking end 58 and the end portions 53 on tabs 51. By using the locking mechanism 50 to maintain the associated socket 75 in place rather than a wedging action of the sockets 75, and the ledge members 45, 46, and 47 a more secure positioning of the socket 75 and the light stake 20 is achieved. The socket 75 illustrated is for a size C-7 or C-9 bulb, but it is intended that mini bulbs and their associated wire sets can also be positioned with the light stake 20 of the present invention because the wires from the mini bulb sets can also be trapped in spaces 60 as herein before described. Because the part circular openings 28 only loosely contact the mini bulb sockets, the light stake 20 does not rely on a friction fit between either the C-7 or C-9 bulb sockets or the mini bulb sockets to maintain the lights in their desired position. This results in a more secure and reliable positioning of the light sockets with respect to the stake and is a significant improvement over the art.

Preferably, the light stake 20 including the locking mechanism are molded as a single piece using a suitable synthetic organic resin such as is nylon. The hinges 57 of the locking mechanism 52 are preferably integral with locking mechanism and are of the reduced thickness type. Nylon is a preferred material since it has some flexibility as well as memory.

While there has been disclosed what is considered to be the preferred embodiment of the present invention, it is understood that various changes in the details may be made without departing from the spirit, or sacrificing any of the advantages of the present invention.

I claim:

1. A light stake insertable into the ground for positioning a series of decorative bulbs in sockets along a wire connecting the sockets at predetermined positions above the ground, comprising: a base having an elongated post extending perpendicularly therefrom; said base being capable of maintaining sockets having different diameters, a locking mechanism on said base movable between an open position and a locked position; said locking mechanism cooperating with said base fixedly to position the wire connecting the series of decorative bulb sockets with respect to said base when said locking mechanism is in the locked position thereof and the wire is trapped against said base by said locking mechanism.

2. The light stake of claim 1, wherein said base is shaped to accept a socket for a C-7 or C-9 bulb or a socket for a mini bulb.

3. The light stake of claim 2, wherein said base loosely holds a socket for a C-7 or C-9 bulb in an orientation generally axially aligned with said post.

4. The light stake of claim 3, wherein said base loosely postions the socket for a mini bulb in an orientation generally axially aligned with said post and said locking mechanism maintains the socket for a mini bulb in place by fixedly positioning the wire connecting the sockets for the mini bulbs with respect to said base.

5. The light stake of claim 1, wherein there are two locking mechanisms on said base.

6. The light stake of claim 5, wherein said base has a generally arcuate periphery and said locking mechanism are opposite each other.

7. The light stake of claim 6, wherein said base has an upstanding ledge along at least a portion of the periphery loosely to engage a socket for a C-7 or C-9 bulb.

8. The light stake of claim 5, wherein each locking mechanism includes a first tab extending beyond said base and a second tab extending beyond said base spaced from said first tab defining a wire receiving space therebetween and a movable tab for connecting the first and second tabs, thereby closing the space to trap a wire positioned therebetween.

9. The light stake of claim 8, wherein said base and said movable tab of each locking mechanism are integral with one of said first or second tabs.

10. The light stake of claim 9, wherein said light stake is a one piece synthetic organic resin.

11. The light stake of claim 10, wherein said synthetic organic resin is nylon.

12. A light stake for positioning a series of decorative bulbs in sockets along a wire connecting the sockets at predetermined positions above the ground, comprising: a generally flat base having a bail portion extending therefrom and an elongated post integral with and extending beyond said bail portion perpendicularly with respect to said bail portion, said base being capable of maintaining sockets having different diameters at predetermined orientations to said elongated portion, a locking mechanism on said base, movable between an open position and a locked position, said locking mechanism cooperating with said base fixedly to position the wire connecting a series of decorative bulb sockets with respect to said base when said locking mechanism is in the locked position thereof and the wire is trapped against said base by said locking mechanism.

13. The light stake of claim 12, wherein said base is circular with an upstanding ledge extending at least around a portion of the periphery of said base and a slot in said base; said ledge portion loosely engaging the sockets for C-7 or C-9 bulb and said slot loosely engaging a socket for a mini bulb.

14. The light stake of claim 13, wherein there are two locking mechanism spaced 180° apart.

15. The light stake of claim 14, wherein each locking mechanism includes a first tab extending beyond said base and a second tab extending beyond said base spaced from said first tab defining a wire receiving space therebetween and a movable tab for connecting the first and second tabs to trap a wire positioned therebetween.

16. The light stake of claim 15, wherein said base and said movable tabs of said locking mechanisms are integral with one of said first or second tabs.

17. The light stake of claim 16, wherein the diameter of said bail portion fits at a juncture of said bail portion and said base within a ¾" schedule 40 pipe.

18. The light stake of claim 16, wherein the juncture between said bail portion and said post fits within a ¼" pipe.

19. The light stake of claim 16, wherein the diameter of said bail portion at a juncture of said bail portion and said base fictionally fits within a ¾" schedule 40 pipe and the juncture between said bail portion and said post fits within a ¼" pipe to permit said light stake to fit within a ¾" pipe or ¼" pipe to elevate said light stake to a predetermined position above the ground greater than the longitudinal extent of said post.

20. The light stake of claim 12, wherein said post is cruciform in transverse cross section.

21. A light stake insertable into the ground for positioning a series of decorative bulbs in sockets along a wire connecting the sockets at predetermined positions above the ground, comprising: a base having an elongated post extending perpendicularly therefrom; a locking mechanism on said base movable between an open position and a locked position; said locking mechanism cooperating with said base fixedly to position the wire connecting the series of decorative bulb sockets with respect to said base when said locking mechanism is in the locked position thereof and the wire is trapped against said base by said locking mechanism; said base being shaped to loosely hold a socket for a C-7 or C-9 bulb or a socket for a mini bulb in an orientation generally axially aligned with said post.

22. A light stake insertable into the ground for positioning a series of decorative bulbs in sockets along a wire connecting the sockets at predetermined positions above the ground, comprising: a base having an elongated post extending perpendicularly therefrom; two locking mechanisms on said base each movable between an open position and a locked position; said locking mechanism cooperating with said base fixedly to position the wire connecting the series of decorative bulb sockets with respect to said base when said locking mechanisms are in the locked positions thereof and the wire is trapped against said base by said locking mechanism; said locking mechanisms being generally arcuate and are opposite each other; each locking mechanism includes a first tab extending beyond said base and a second tab extending beyond said base spaced from said first tab defining a wire receiving space therebetween and a movable tab for connecting the first and second tabs to trap a wire positioned therebetween.

23. A light stake for positioning a series of decorative bulbs in sockets along a wire connecting the sockets at predetermined positions above the ground, comprising: a generally flat base having a bail portion extending therefrom and an elongated post extending beyond said bail portion perpendicularly with respect to said base, a locking mechanism on said base movable between an open position and a locked position, said locking mechanism cooperating with said base fixedly to position the wire connecting a series of decorative bulb sockets with respect to said base when said locking mechanism is in the locked position thereof and the wire is trapped against said base by said locking mechanism; said base being circular with an upstanding ledge extending at least around a portion of the periphery of said base and a slot in said base; said ledge loosely engaging the sockets for C-7 or C-9 bulb and said slot loosely engaging the socket for a mini bulb.

24. A light stake for positioning a series of decorative bulbs in sockets along a wire connecting the sockets at predetermined positions above the ground, comprising: a generally flat base having a bail portion extending therefrom and an elongated post extending beyond said bail portion perpendicularly with respect to said base, a locking mechanism on said base movable between an open position and a locked position, said locking mechanism cooperating with said base fixedly to position the wire connecting a series of decorative bulb sockets with respect to said base when said locking mechanism is in the locked position thereof and the wire is trapped against said base by said locking mechanism; wherein said base loosely positions the socket for a mini bulb in an orientation generally axially aligned with said post and said locking mechanism maintains the socket for a mini bulb in place by fixedly positioning the wire connecting the sockets for the mini bulbs with respect to said base.

* * * * *

UNITED STATES PATENT AND TRADEMARK OFFICE

CERTIFICATE OF CORRECTION

PATENT NO. : 5,570,952
DATED : November 5, 1996
INVENTOR(S) : William F. Protz, Jr.

It is certified that error appears in the above-indentified patent and that said Letters Patent is hereby corrected as shown below:

Claim 12, line 1, after the word "stake" insert --insertable into the ground--.

Claim 23, line 1, after the word "stake" insert --insertable into the ground--.

Claim 24, line 1, after the word "stake" insert --insertable into the ground--.

Signed and Sealed this

Fourth Day of March, 1997

*Attest:*

Bruce Lehman

BRUCE LEHMAN

*Attesting Officer*

*Commissioner of Patents and Trademarks*